US005289636A

United States Patent [19]

Eichhorn et al.

[11] Patent Number: 5,289,636

[45] Date of Patent: Mar. 1, 1994

[54] ELECTRIC SHAVING APPARATUS

[75] Inventors: Reinhold Eichhorn, Idstein-Kröftel; Gerhard Schäfer, Frankfurt; Klaus Oprach, Schwalbach; Sigrun Hickel, Schmitten; Helmut Dürr, Frankfurt, all of Fed. Rep. of Germany

[73] Assignee: Braun Aktiengesellschaft, Frankfurt, Fed. Rep. of Germany

[21] Appl. No.: 931,857

[22] Filed: Aug. 18, 1992

[30] Foreign Application Priority Data

Aug. 26, 1991 [DE] Fed. Rep. of Germany ..... 4128217

[51] Int. Cl.[5] ..... B26B 19/10

[52] U.S. Cl. ..... 30/43.92; 30/34.1; 30/43.1

[58] Field of Search ..... 30/34.1, 43.1, 43.92, 30/89

[56] References Cited

U.S. PATENT DOCUMENTS 4,283,848 8/1981 Messinger et al. ..... 30/34.1
4,505,036 3/1985 Ochiai et al. ..... 30/89
4,594,777 6/1986 Kimoto et al. ..... 30/42
4,930,217 6/1990 Wolf et al. ..... 30/34.1
5,054,199 10/1991 Ogawa et al. ..... 30/34.1
5,084,967 2/1992 Nakagawa et al. ..... 30/34.1

FOREIGN PATENT DOCUMENTS 2843947 10/1978 Fed. Rep. of Germany .
3726354 8/1987 Fed. Rep. of Germany .

*Primary Examiner*—Richard K. Seidel
*Assistant Examiner*—Hwei-Siu Payer
*Attorney, Agent, or Firm*—Fish & Richardson; 10

[57] ABSTRACT

The invention is directed to an electric shaving apparatus with a first slide switch slidably arranged on a housing for operating a short-hair cutter assembly K1, K2, with a long-hair trimmer L displaceable by means of a slider as well as a second adjustable slide switch for operating at least one of the cutters. The second slide switch automatically follows in a defined range the control movement of the first slide switch into at least one further control position. The second slide switch is then movable into a cutter assembly locking position in opposition to the direction of the movement of the first slide switch.

26 Claims, 7 Drawing Sheets

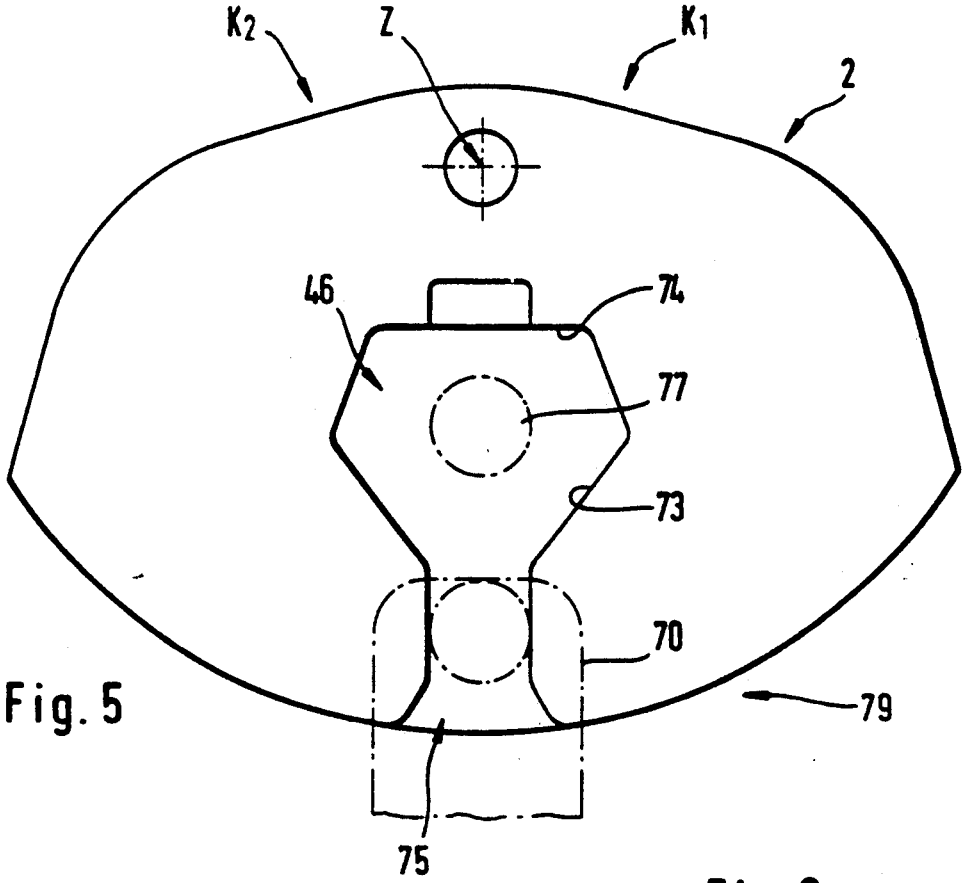
Fig. 5
Fig. 9
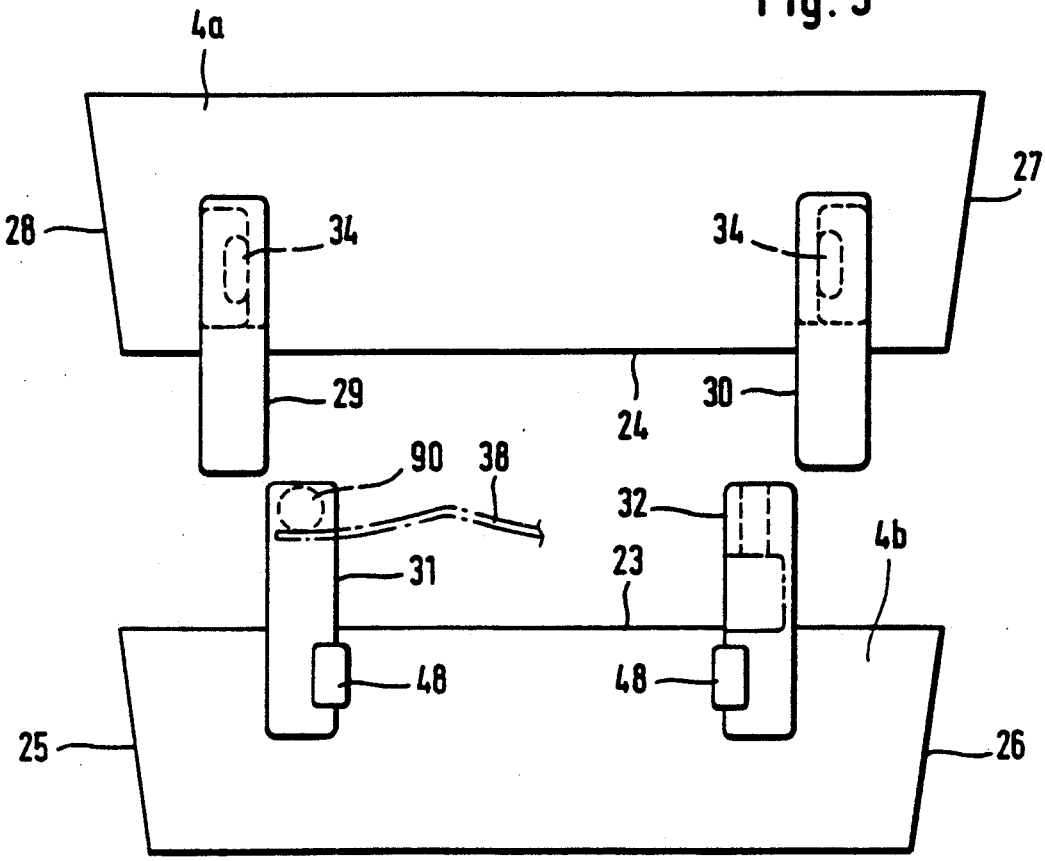

ELECTRIC SHAVING APPARATUS

This invention relates to an electric shaving apparatus with a first slide switch slidably arranged on a housing for operating a pivotally mounted short-hair cutter assembly and for displacing a long-hair trimmer.

A shaving apparatus of the type initially referred to is know from DE-37 26 354 A1. Associated with the slide switch provided for operation of the shaving apparatus is a control element which is engageable with at least one sequential control element provided on the shaving head by operation of the slide switch, in order to move the freely pivoted shaving head from any one of its pivotal positions into a predetermined locating position in which it is locked.

An electric shaving apparatus having a first slide switch slidably mounted on a housing for operating a short-hair cutter assembly is already known (DE 28 43 947 C2). Disposed on the slide switch is a long-hair trimmer which is slidable from a deactivated position into an operating position and is coupled to the drive mechanism of the dry shaving apparatus when in the operating position, with resilient means being provided for retaining the trimmer in either position. A second slide switch serving for turning the dry shaving apparatus on and off is associated with the first slide switch. This facilitates manipulation of the shaving apparatus, enabling the appliance to be turned on and off without the need to change the gripping position, and also the long-hair trimmer to be activated.

It is an object of the present invention to have controls available directly on the shaving apparatus affording, in addition to the other control functions for the long- and short-hair cutter assemblies, a very simple means of controlling or locating a pivotal shaving head for various functions.

This object is accomplished by the invention in that a second slide switch is provided which automatically follows the control movement of the first slide switch into a further control position, thereby locking or unlocking the pivotal movement of the pivoted short-hair cutter assembly.

This affords a simple means of locking or releasing the pivotal movement of the pivoted short-hair cutter assembly if at least the short-hair cutter assembly or the short-hair cutter assembly together with the long-hair trimmer has been shifted into an operating position. In this arrangement, the second slide switch is advantageously movable in opposition to the control movement of the first slide switch against the action of a control means into a position locking the pivotally mounted short-hair cutter assembly.

In a further feature of the present invention, the second slide switch is advantageously movable from a non-locking position into a position locking the pivotal short-hair cutter assembly against the action of a spring, from which locking position the second slide switch is capable of moving into its initial position or in the non-locking position by means of a further spring. Because the second slide switch is advantageously movable in opposition to the control movement of the first slide switch and against the action of a control means into a position locking the pivoted short-hair cutter assembly, it is ensured in a simple manner that the pivoted short-hair cutter assembly is not movable into a locking position until at least the short-hair cutter assembly has been brought to an operating position. The spring acting on the second slide switch ensures that the second slide switch follows automatically the control movement of the first slide switch, invariably returning to its initial position in which the shaving head is released for pivotal movement. For example, if the operator wishes the shaving head to be temporarily locked for a shave in the area of his upper lip, all he has to do is keep the second switch pushed down for the desired period of time. After the operator eases the pressure on the second slide switch, it will automatically return to its initial position in which it abuts the first slide switch.

Finally, in a preferred embodiment of the solution of the invention, the first and the second slide switch include each two relatively spaced guide means which are received in apertures provided in the adjustable slider and are movable into engagement with abutment stops provided in the apertures. In addition to providing a simple, yet highly suitable guide for the slide switches, this arrangement provides at the same time abutment stops for shifting the slider and thus for shifting the long-hair trimmer into at least one operating position.

It is of particular importance for the present invention that the first and the second slide switch are carried on a slider displaceable in the housing of the shaving apparatus and movable by means of the first slide switch from an "Off" position into at least one operating position.

In connection with the configuration and arrangement of the present invention, it is an advantage that the long-hair trimmer is arranged on the slider displaceably mounted in the housing and bearing against the housing through the spring which is configured as a spring clip and which, after overcoming a dead-center position, moves the slider of the long-hair trimmer upwardly or downwardly, supporting its movement.

Further, it is advantageous that the spring has one end thereof fastened to a bolt of the housing while its other end takes support in a recess provided in the slider and rolls of f therein, wherein the slider, in a lower position, is adapted to be located on the housing by a resilient locating element. In this manner, simple constructional means are provided by means of which the displacement of the slider is substantially facilitated and an effective locking action is accomplished.

In another advantageous feature, the first and the second slide switch are guided on the upper side of the slider, and a coulisse is guided on the underside of the slider.

An additional possibility of fastening the slide switch is afforded in that the first slide switch is fixedly connected with two corresponding relatively spaced support brackets of the coulisse through two coupling elements.

In a further advantageous feature of the present invention, a supporting structure having a bearing shell for receiving a detent hook is provided at the lower end of the coulisse, the hook having a detent member for arresting the coulisse on the slider. Further it is advantageous that the rear side of the detent member bears against a two-legged spring having its one leg in locking engagement with a locating means of the coulisse, being thereby secured in position. A perfect locking engagement of the detent member with the locating means of the coulisse is thereby accomplished, even in the event that the detent member should be firmly anchored to a joint and be insufficiently flexible or the resilient actuating forces inherent in the detent member were insufficient to urge it into the locating recesses. In another advantageous feature, the detent hook is comprised of a semispherical detent member and a rotary foot connected through an arm with the detent member, the rotary foot being received within the bearing shell provided on the coulisse for rotary movement therein in any direction. In this manner, the detent member is readily displaceable into the appropriate locating position also in cases where manufacturing tolerances are not held.

In another advantageous feature of the present invention, the detent member of the coulisse is engageable with a notch provided on the slider and is unable to disengage from the notch until a suitable catch releases the detent member of the coulisse. The detent member enables the long-hair trimmer to be locked in its "Off" position in a very simple manner, thereby ensuring that the long-hair trimmer is not activated unless the short-hair cutter assembly is turned on.

Another essential advantage of the present invention is realized in that the catch is part of a locking switch which, for being moved into the locking position, is displaceable into the same direction as the first and the second slide switch when these are moved to their "Off" positions.

In accordance with another feature of the device of the present invention, an additional possibility is afforded in that the locking switch includes a plate on which the first resilient catch and a second resilient catch in the form of a downwardly open fork are provided, with the second catch being engageable in corresponding notches of the slider.

A further advantage is that in the locking position the first catch slides between the detent member of the coulisse and a rib structure arranged on the frame and prevents the detent member of the coulisse from pivoting about its bearing shell and releasing the coulisse for effecting a control operation. It is thereby ensured that the locking switch does not release the long-hair trimmer for displacement until the short-hair cutter assembly is activated.

In an essential advantageous embodiment, in the operating position of the long-hair trimmer the detent member of the coulisse is between the upper notch and a rib structure provided on the frame, preventing in this position a displacement of the short-hair cutter assembly into an "Off" position, while in the operating position of the long-hair trimmer the second catch is between a nose arranged on the coulisse and a notch on the slider, thereby preventing the second catch from being disengaged from the notch on the slider, which ensures that the locking switch cannot be returned to its locking position until both cutters have been moved to their "Off" positions.

In another advantageous feature, the locating element is provided on the slider of the shaving apparatus which in the "Off" position of the shaving apparatus is slid over a semispherical raised portion provided on the frame of the shaving apparatus, resiles somewhat on displacement of the locating element into the operating position and, as this occurs, travels over the semispherical raised portion. This enables the long-hair trimmer to be locked in its "Off" position in a simple manner.

Further, it is advantageous to provide a knob on the rear side of the catch of the locking switch, which knob, in relation to the locking position of the locking switch, is arranged below a further knob provided on the rib structure of the frame, thereby preventing the catch from being disengaged from its locked position on the slider because of the nose disposed on the coulisse. As a result, the appliance can not be turned off by means of the locking switch. Further, in this position the short-hair cutter assembly continues to be activated for as long as the long-hair trimmer is in a corresponding operating position.

An additional possibility afforded by a further feature of the device of the invention is that a control element configured as a push rod is slidably carried in the housing for locating the shaving head, the control element being biased in the longitudinal direction of the shaving apparatus against the pressure of a torsion spring resting with one end against the push rod and with its other end against a strut member secured in the housing, and the push rod is operatively associated with the slide switch through an engaging means provided on the push rod and is movable by means of the slide switch against the action of at least one spring into a position locking the shaving head. The push rod being actuatable by means of the slide switch, the shaving head can be temporarily locked in position when a pivoting movement of the shaving head is not desired during the shave. The automatic return capability ensures that the shaving head is subsequently released again for further pivotal movements.

The coordination of functions and adaptation of the control travels and control directions of the first and second slide switch and the locking switch as accomplished by the invention results in a substantial simplification of the operation of the shaving apparatus. To operate the shaving apparatus for use, it is necessary to actuate the locking switch and the first slide switch in the same direction, the second slide switch which is provided as a short-time switch automatically following this direction of movement, thereby releasing the short-hair cutter assembly, which is in locked condition with the shaving apparatus off, and enabling it to perform pivotal movements. In this On position, the user has the option to lock the short-hair cutter assembly by actuating the short-time switch in opposition to the actuating direction of the first slide switch, unlocking it again by releasing the short-time switch. To deactivate the shaving apparatus, it is necessary to move the first slide switch in opposition to the activating direction, whereby it automatically picks up the short-time switch and the slider with the integrated long-hair trimmer into the Off position—provided that the long-hair trimmer is extended relative to the short-hair cutter assembly—, the short-time switch locating in the process the shaving head by means of the push rod engaging in the shaving head. By subsequent actuation of the locking switch which is equally required in the Off direction of the first slide switch, the switch system of the shaving apparatus is secured against inadvertent activation.

An embodiment of the present invention will be described in the following by way of example, reference being had to the accompanying drawings. In the drawings,, FIG. 1 is a perspective view of a shaving apparatus including a pivotally mounted shaving head as well as a long-hair trimmer and three different actuating switches;

FIG. 5 is a partial longitudinal sectional view of the shaving apparatus of FIG. 1 including the pivotally mounted shaving head;

FIG. 9 is a view of the slide switch and the short-time switch adapted to be mounted on the frame.

Figure 1:
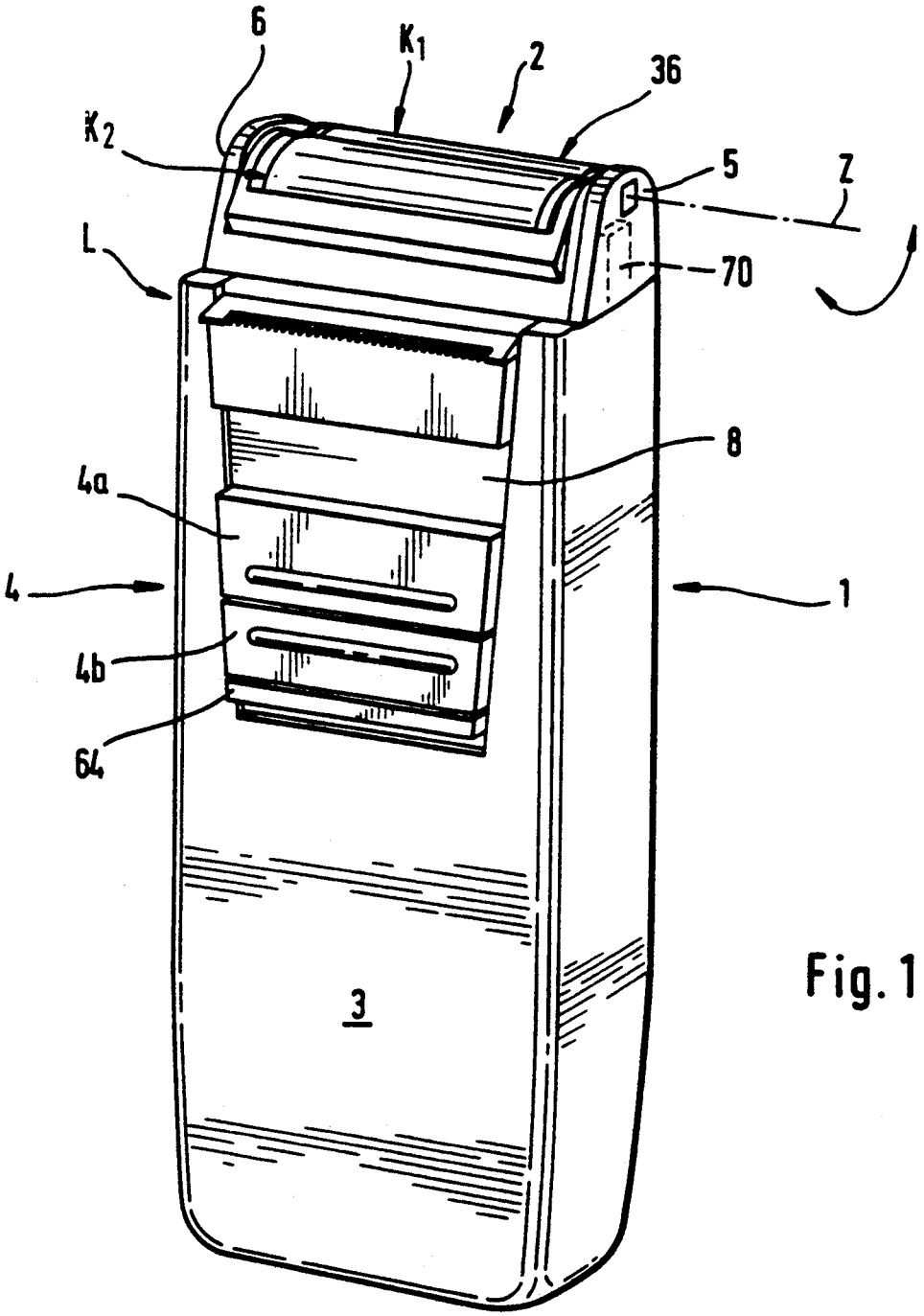
Figure 8:
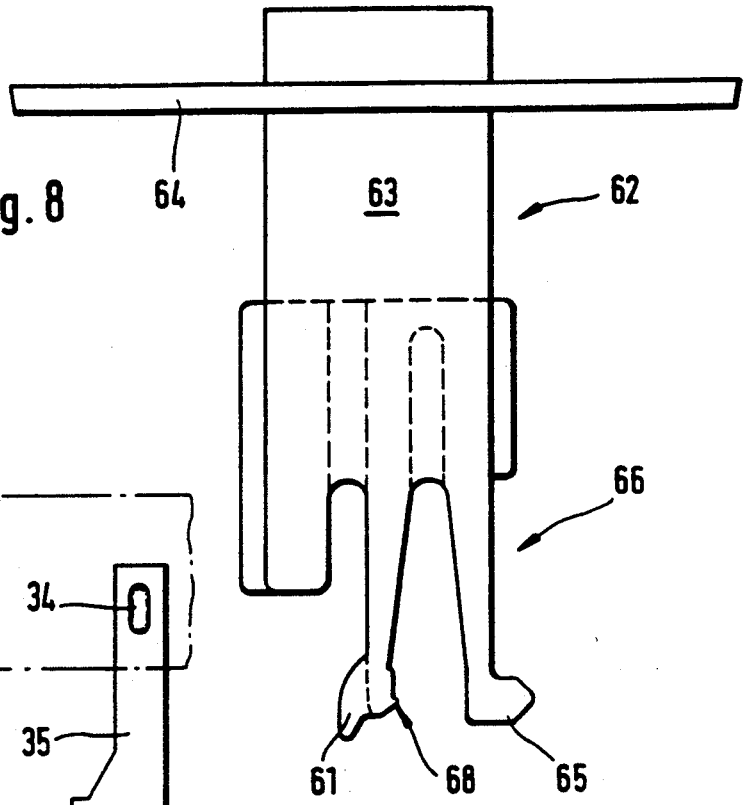
FIG. 8 is a view of a locking switch.

Referring now to FIG. 1 of the drawings, there is shown an electric shaving apparatus having a housing 1 and a shaving head 2 incorporating two short-hair cutter assemblies K1, K2 pivotal relative to the housing 1 about a pivotal axis Z from the mid-position shown into opposite directions, further having a first slide switch 4*a* which is slidably arranged on the front panel 3 of the housing 1 and may also be referred to as an On/Off switch, a second slide switch or short-time switch 4*b*, and a grip structure 64 of a locking switch 62 described in the following and illustrated in detail in FIG. 8.

The shaving head 2 is pivotally mounted relative to the housing 1 and equipped with an outer cutter 36 and an inner cutter, not shown, which is operatively associated with the outer cutter 36 and driven by a motor not shown in the drawings. With the switch in a corresponding position, bearing elements not shown in the drawings hold the shaving head 2 in a freely pivotal relationship between two support lugs 5, 6 integrally formed on the housing 1, which lugs may also be part of a shaving head frame seated on the housing 1.

The slide switch 4*a*, the short-time switch 4*b* and the grip structure 64 are slidably mounted on the front panel 3 of the housing 1 on a slider 8 displaceable in the housing 1 and integrally formed with a long-hair trimmer L.

The long-hair trimmer L is equally driven by the electric motor, not shown in the drawings, which causes oscillation of the long-hair trimmer L by means of an oscillating lever, not shown, and an engaging means of the long-hair trimmer L. The electric motor includes a suitable driving pin, not shown in the drawings, which is received in a slotted guide of the oscillating lever carried in the slider 8, thereby producing an oscillating movement of the engaging means of the long-hair trimmer L.

Figure 2:
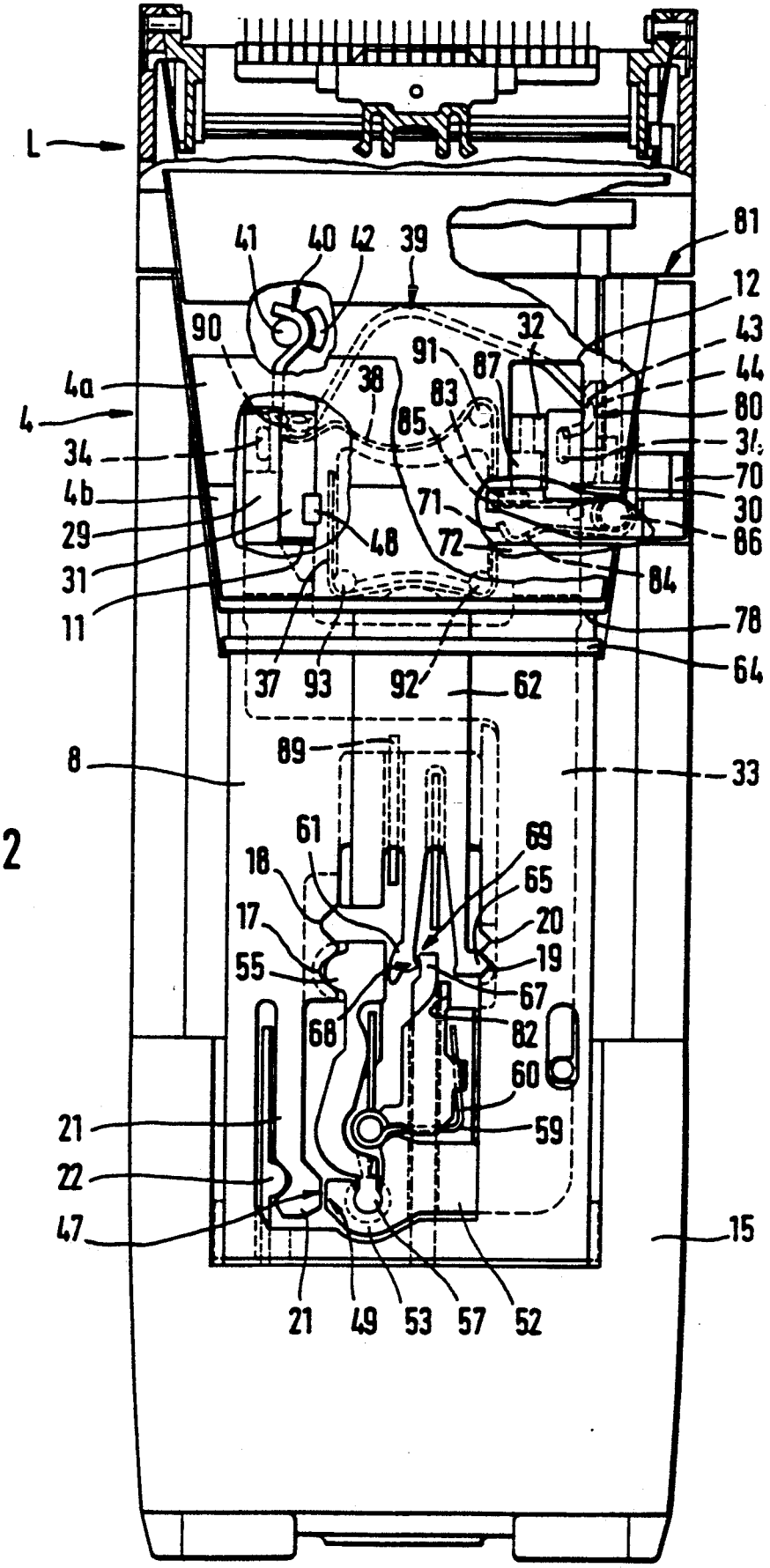
FIG. 2 is a schematic view of the frame of the shaving apparatus showing the individual controls and locating elements in the "Off" position.

The housing 1 accommodates a frame 15 for receiving the slider 8. As becomes apparent from FIG. 6, the slider 8 is comprised of a trapezoidally diverging upper portion 9 and a rectangular lower portion 10. The upper portion 9 includes two relatively spaced rectangular apertures 11, 12 each having an upper abutment stop 13 and a lower abutment stop 14. The lower portion 10 includes a rectangular cutout 16 in which two left-hand locating positions or notches 17 and 18, two right-hand locating positions or notches 19 and 20, and a resilient locating element 21 are provided. In the "Off" position of the shaving apparatus as shown in FIG. 2, the locating element 21 is pushed over a semispherical raised portion 22. On displacement of the locating element 21 into the "Off" position of FIG. 2, the locating element 21 slightly resiles. According to FIG. 2, the semispherical raised portion 22 is provided on the frame 15 of the shaving apparatus.

Figure 3:
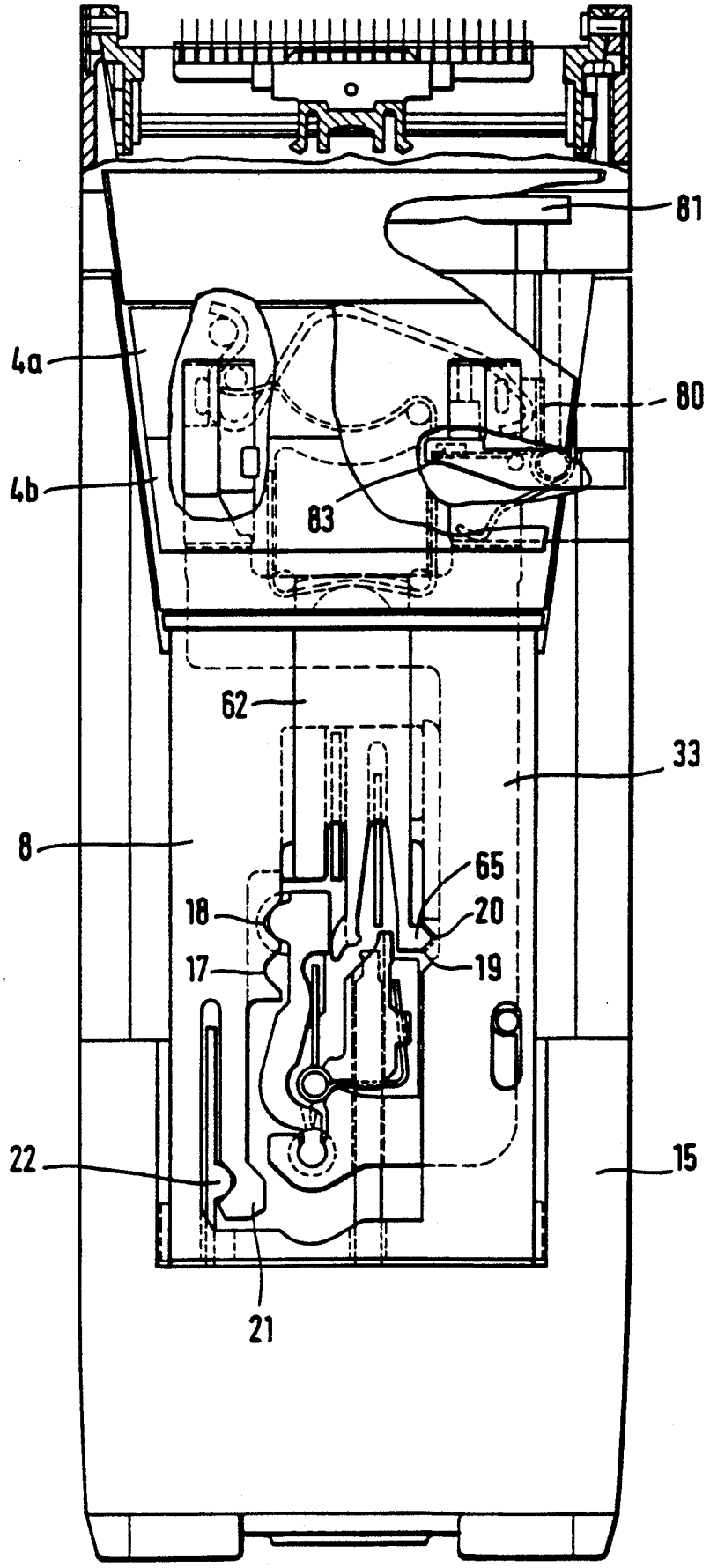
FIG. 3 is a view of the frame of the shaving apparatus showing the individual controls and locating elements in the first operating position in which the short-hair cutter assembly is activated.
Figure 4:
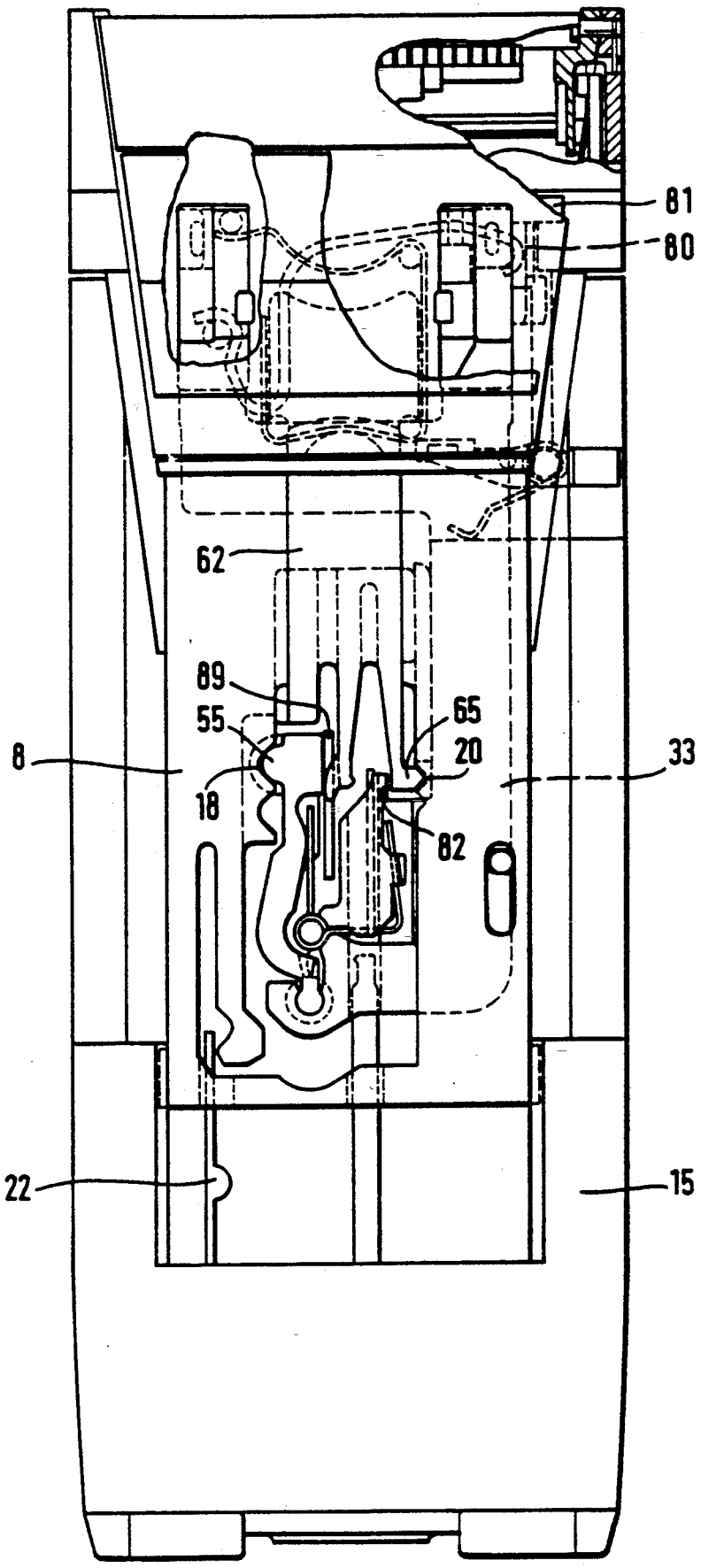
FIG. 4 is a view of the frame of the shaving apparatus showing the individual controls and locating elements in the second operating position in which both the short-hair cutter assembly and the long-hair trimmer are activated.

FIGS. 2 to 4 show the slider 8 disposed in the frame 15 in two different switch positions. In FIG. 2, the shaving apparatus is in an "Off" position, in FIG. 3, it is in an operating position in which the short-hair cutter assembly K1, K2 is on and the long-hair trimmer is off, and in FIG. 4 it is in an operating position in which the long-hair trimmer L is on in combination with the short-hair cutter assembly K1, K2. To use the shaving apparatus, it is provided with a switching device 4 comprising the first slide switch 4*a*, the second slide switch 4*b*, and the slider 8.

To activate the short-hair cutter assembly K1, K2, the slide switch 4*a* and at the same time the slide switch 4*b* are moved from the position shown in FIG. 2 into the position shown in FIG. 3. When the switching device 4 is moved to the position shown in FIG. 4, the long-hair trimmer L is additionally activated through the guide means 29, 30 explained in the following (see FIG. 9) which in this position rest against the upper abutment stops 13 (see FIG. 6).

As explained in the subsequent description, a single switch suffices to bring the shaving apparatus into various operating positions, an "Off" position and then through a locking switch 62 into a locking position preventing accidental displacement of the switch into an operating position.

Details of the switching device 4 incorporating the slide switch 4*a* and the slide switch 4*b* are illustrated in FIGS. 2 to 4 and in FIG. 9.

In FIG. 9, both the slide switch 4*a* and the slide switch 4*b* are of a trapezoidal configuration, diverging in upward direction. When the top edge 23 of the slide switch 4*b* is moved into abutment with the bottom edge 24 of the slide switch 4*a*, the two diverging outer edges 25, 26 of the slide switch 4*b* extend in the same inclined plane as the two outer edges 27, 28 of the slide switch 4*a*. The slide switch 4*a* and the slide switch 4*b* are each provided with two guide means 29, 30 and 31, 32, respectively. To enable the slide switch 4*b* to be moved into abutment with the slide switch 4*a*, the two guide means 29, 30 are at a wider relative spacing than the two guide means 31, 32. The guide means 29 to 32 are fixedly connected or welded to the plates. The two guide means 31, 32 are additionally guided on or secured to the slider 8 by two hook members 48 embracing the slider 8 as shown in FIGS. 2 and 9.

In juxtaposed position, the two guide means 29, 31 and 30, 32 combine to a width such that they are readily insertable in the corresponding apertures 11 and, respectively 12, of the slider 8, as shown in FIG. 2.

The slide switch 4*a* and the slide switch 4*b* are guided on the upper side of the slider 8, while a coulisse 33 (see also FIG. 7) is guided on the underside of the slider 8. The slide switch 4*a* is fixedly connected with two corresponding relatively spaced support brackets 35 of the coulisse 33 by means of two elongate knobs 3 4. For assembly, the slide switch 4*a* and the slide switch 4*b* with the coulisse 33 are inserted in the slider 8 and connected to the coulisse 33 from the rear side.

As becomes apparent from FIGS. 2 to 4, the slide switch 4*b* has its top edge 23 at all times in abutment with the bottom edge 24 of the slide switch 4*a*. This is accomplished by a rectangular spring 37 which is configured as a leg spring having its one leg 38 bearing against a bolt 90 provided on the slide switch 4b, thereby urging the slide switch 4b upwardly. The bolts 91, 92 and 93 serve to locate the spring 37 in position on the slider 8.

The slide switch 4b can be pulled downwardly by about four millimeters, in order to temporarily lock the pivotally mounted short-hair cutter assembly K1, K2. Movement in downward direction of the slide switch 4b and thus of the guide means 31, 32 against the action of the spring 37 is limited by the abutment stops 14 (see FIG. 6). The spring 37 causes the slide switch 4b to have its top edge 23 at all times in engagement with the bottom edge 24 of the slide switch 4a.

In the upper area (see FIG. 2), the slider 8 takes support upon a spring 39 configured as a spring clip. At its left-hand end, the spring 39 is provided with a hook member 40 arranged on a projecting bolt 41 provided on the frame 15, being clamped between the bolt 41 and a holding structure 42 conformed to the hook member 40. At its end opposite the hook member 40, the spring has another hook member 43 which is outwardly bent and bears against a recess 44 in the slider 8 conformed to the hook member 43, thereby causing the slider 8 to bear with an abutment stop 80 thereof upwardly against another abutment stop 81, until the long-hair trimmer L is urged downwardly by a counterforce.

In FIG. 2, the long-hair trimmer L is not illustrated, only its position is indicated. The long-hair trimmer L is inserted at the upper end of the slider 8 and secured by suitable clip members not shown in the drawings (see FIG. 1).

In the position shown in FIG. 2, the spring 39 is displaced downwardly over its dead-center position, exerting in this position a downward control force and supporting the movement of the slider 8 into an "Off" position.

For displacement of the slider 8 by means of the slide switch 4a into the position shown in FIG. 4, the two guide means 29, 30 act against the abutment stops 13 in the slider 8, thereby causing the slider 8 to travel upwardly. At the same time, the spring 39 is pivoted upwardly over its dead-center position and biased such as to support the movement of the slider 8 upwardly into an operating position. For downward displacement of the slider 8, the guide means 29, 30 act through the lower abutment stops 14 on the slider 8, causing it to travel downwardly, with the spring 39 supporting the control movement of the slider 8.

As becomes apparent from FIG. 2, the slider 8 has in its bottom left-hand area a resilient locating element 21 resting with its lower end against the semispherical raised portion 22 serving as an abutment. In this position, the shaving apparatus is in an "Off" position (FIG. 2) in which the long-hair trimmer L is equally locked. In this position, the slider 8 with the long-hair trimmer L is completely blocked and cannot even be forced upwardly by actuating the slider 8 through the slide switch 4a, because the locating element 21 is unable to escape to the rear. This is prevented by the coulisse 33 being in the lower position which would have its end 49 in abutment with the rear end 47 of the locating element 21. Accordingly, the slider 8 cannot be displaced until after the coulisse 33 is moved from the position shown in FIG. 2 into the position shown in FIG. 3.

Figure 7:
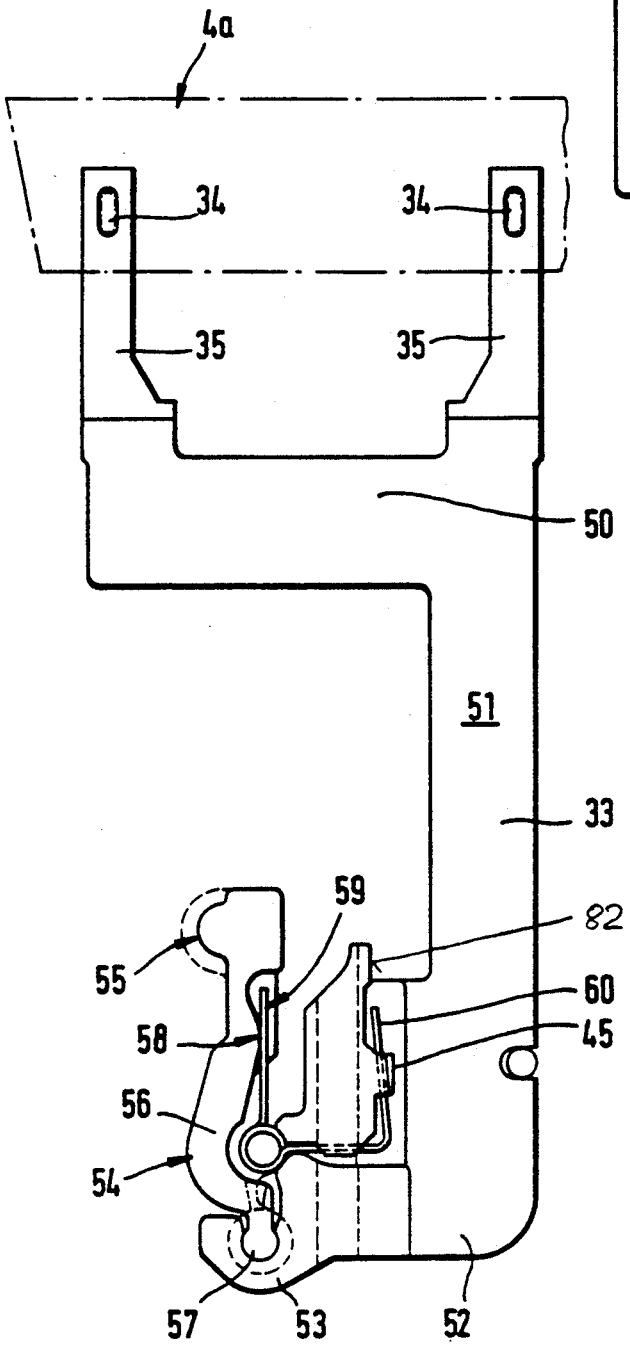
FIG. 7 is a view of the coulisse adapted to be slidably mounted on the frame so as to assume various control positions.

In FIGS. 2 to 4, the coulisse 33 is shown in broken lines, while it is drawn in full in FIG. 7. The coulisse 33 is comprised of a unshaped upper member 50 including the two support brackets 35 and connected through a link 51 with a lower supporting structure 52. A bearing shell 53 for receiving a detent hook 54 is provided on the supporting structure 52.

Figure 6:
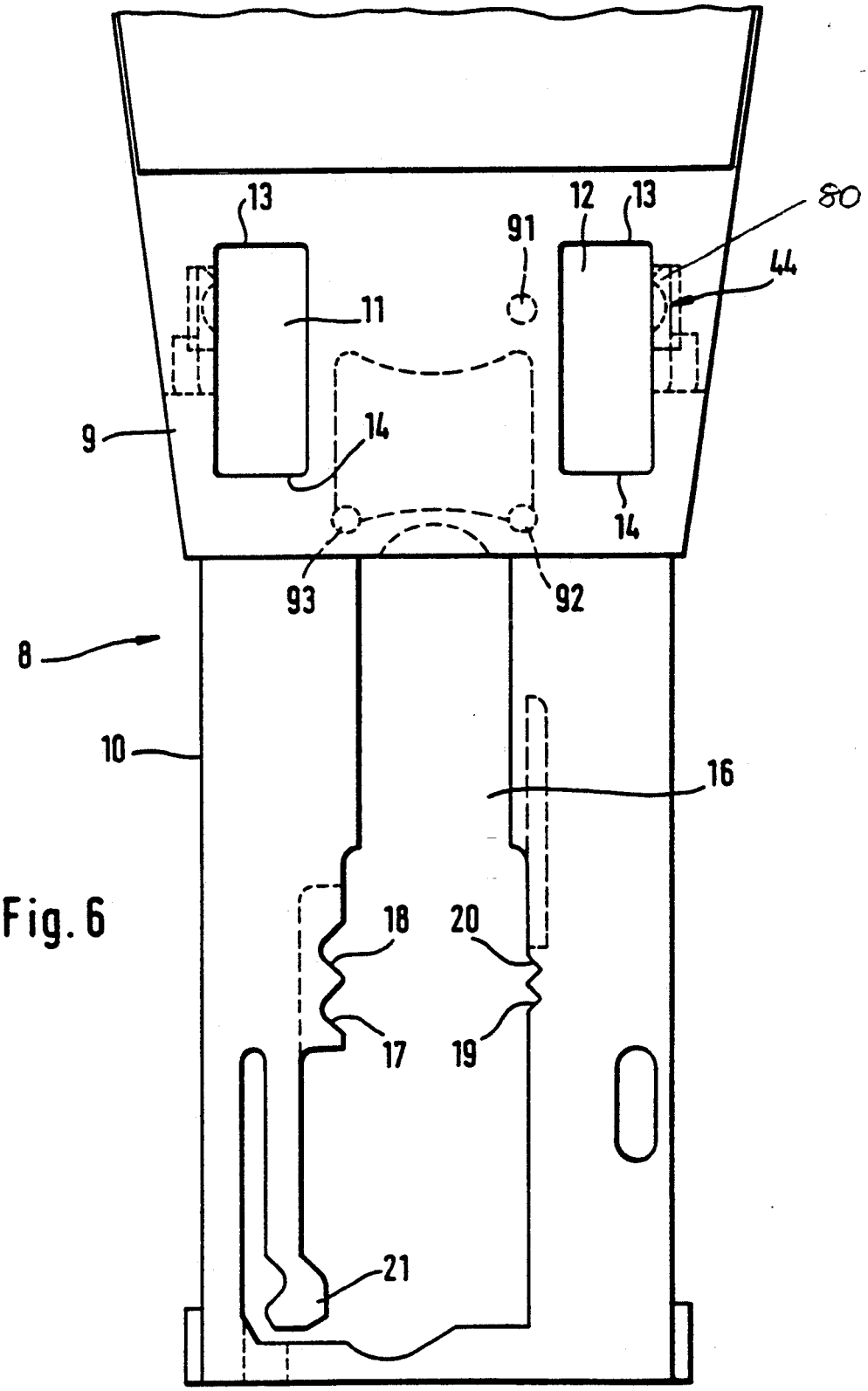
FIG. 6 is a view of a frame serving to accommodate the individual functional parts of the shaving apparatus.

The detent hook 54 is comprised of a semispherical detent member 55 and a rotary foot 57 connected to the detent member 55 by means of an arm 56. The rotary foot 57 is received in the bearing shell 53 for rotary movement therein in any direction. The rear side 58 of the arm 56 bears against a two-legged spring 59 having its one leg 60 in locking engagement with a locating means 45 of the coulisse 33, being thus secured in position. The spring 59 ensures that the detent member 55 locks into a first or second notch 17, 18 provided on the slider 8 as shown in FIGS. 2 and 6 at a uniform contact pressure.

The detent member 55 cannot be moved out of the notch 17 until after a corresponding catch 61 is displaced from the position shown in FIG. 2 into the position shown in FIG. 3.

The catch 61 is part of the locking switch 62 shown in FIG. 8. This switch is comprised of a plate 63 of approximately rectangular shape incorporating the grip structure 64 (see also FIG. 2) by means of which the locking switch 62 is displaceable from the position shown in FIG. 2 into the position shown in FIG. 3. Provided on the plate 63 are the first resilient catch 61 and a second resilient catch 65 in the form of a downwardly open fork 66. The second catch 65 is lockable into the corresponding notches 19, 20 of the slider S. The plate 63 of the locking switch 62 is displaceable between two different locating positions 19, 20 inside the rectangular cutout 16 of the slider 8.

In the position shown in FIG. 2 in which the shaving apparatus is disconnected from the power supply, the locking switch 62 resides within a notch 19. In this position, the catch 61 is between the detent member 55 and a rib structure 67 provided on the frame 15, thus preventing the detent member 55 from pivoting to the rear about its bearing shell 53.

The locking switch 62 is slidably received in the slider 8, the grip structure 64 enabling it to be displaced from a notch 19 of FIG. 2 into a notch 20 of FIG. 3 providing an unlocking function. The locking switch 62 accordingly prevents the shaving apparatus from turning itself on accidentally when in transit.

The rear side of the catch 61 is provided with a knob 68 which in the locked position of FIG. 2 lies below a second knob 69 provided on the rib structure 67. This prevents the detent member 55 from sliding past the catch 61 if in the locked position shown in FIG. 2 the operator made an attempt to shift the slide switch 4a (On/Off switch) upwardly with great effort. The knobs 68, 69 present an additional catch.

FIG. 5 further shows the upper portion of the shaving apparatus of FIG. 1 including a control means 79 for the pivoted shaving head.

The pivotal movement of the shaving head 2 can be temporarily stopped by a control element. Functioning as a control element is a push rod 70 illustrated only in part in FIGS. 1, 2 and 5, the push rod being displaceably carried in the housing 1 and being biased in the longitudinal direction of the shaving apparatus against the pressure of a spring 71 bearing with one end against the push rod 70 and with its other end against a fixed strut member 72 (see FIG. 2). The strut member 72 is fixedly connected or formed integrally with parallel wall portions of the frame 15.

As becomes apparent from FIGS. 2 and 5, the push rod 70 extends above the slide switch 4*b* and is operatively associated with it, that is, an engaging means 83 provided on the push rod 70 is operatively associated with the slide switch 4*b*. The spring 71 serves the function of urging the push rod 70 into an enlargement 46 adjacent to an opening 75. This ensures pivotal movement of the shaving head 2. If it is desired to temporarily lock the shaving head 2, the slide switch 4*b* is pushed downwardly against the action of the spring 71 configured as a leg spring and the spring 37, the detent member 77 provided on the push rod 70 being guided along the inclined slide path or coulisse guideway 73 until it falls into the opening 75, thereby locking the shaving head 2. When the operator releases the slide switch 4*b*, it will be urged upwardly by the spring 37, and the push rod 70 will be urged upwardly by the spring 71, causing disengagement of the detent member 77 from the opening 75. The shaving head 2 is then free to pivot again about the pivotal axis Z.

It will thus be seen that the slide path or coulisse guideway 73 provided on the shaving head 2 serves the function of moving the shaving head 2 into a mid-position on a downward displacement of the slide switch 4*b*, thereby enabling the detent member 77 to be readily introduced into the opening 75 in order to temporarily lock the shaving head 2 in its mid-position shown in FIG. 5. By locking the pivotal short-hair cutter assembly K1, K2, the operator is in a position to perform a perfect shave in the area of his upper lip, for example.

The spring 71 illustrated in FIG. 2 is fastened to the push rod 70, bearing with its one leg 84 against the strut member 72 provided on the frame 15 and with its other leg 85 against the push rod 70. The spring 71 may be arranged on a bolt 86 connected to the push rod 70, with the bolt diameter being somewhat smaller than the coil of the spring 71. The spring 71 operates to bias the push rod 70 guiding it thereby upwardly. Accordingly, if the slide switch 4*b* is moved downwardly from the position shown in FIG. 3, it will cause the rib structure 87 to follow its downward movement and introduce the head of the push rod, that is, the detent member 77, into the opening 75, thereby temporarily locking the shaving head 2.

In the positions shown in FIGS. 3 and 4, the slider 8 is displaced upwardly by an amount causing disengagement of the push rod 70 from its opening 75, which ensures that the shaving head 2 is capable of pivoting when the long-hair trimmer L is activated. The short-time switch has no function in the position shown in FIG. 4.

To move the shaving apparatus from the "Off" position shown in FIG. 2 into the operating position shown in FIG. 3, it is necessary to shift first the locking switch 62 upwardly into the position shown in FIG. 3 by means of the grip structure 64 which, as this occurs, is brought into abutment with a bottom edge 78 of the slide switch 4*b*. This control operation releases the detent member 55, thereby enabling the slide switch 4*a* to be moved into the operating position shown in FIG. 3. On shifting the locking switch 62 into the position shown in FIG. 3, the catch 65 will fall into the next locating position or notch 20, locking the locking switch 62 again. The coulisse 33 is then slidable by means of the slide switch 4*a* into the position shown in FIG. 3, causing the detent member 55 to move f rom notch 17 into notch 18. This is the operating position of the shaving apparatus, that is, it is connected to the power supply, and the short-hair cutter assembly K1, K2 is in driving relationship to the motor not shown in the drawings. The slide switch 4*b* is caused to follow the slide switch 4*a* by means of the spring 37.

To activate also the long-hair trimmer L, the locating element 21 of the slider 8 is caused to travel across the semispherical raised portion 22 by means of the slide switch 4*a*, reaching the position shown in FIG. 4. As already mentioned, the spring 37 causes the slide switch 4*b* to follow the movement of the slide switch 4*a*. The locking switch 62 remains in the position shown in FIG. 3, being moved upwardly together with the slider 8. As this occurs, the spring 39 supports the sliding motion of the slider 8. When the long-hair trimmer L is activated, the slider 8 has its stop 80 in abutment with a stop 81 provided on the frame 15—see FIG. 4.

To return the shaving apparatus from the position shown in FIG. 4, the slider 8 is returned to the position shown in FIG. 3 by means of the slide switch 4*a*, with the slide switch 4*b* following again the movement of the slide switch 4*a*.

In the position shown in FIG. 4, the detent member 55 is between the upper notch 18 and a rib structure 89 provided on the frame. In this position, also the catch 65 is between a nose 82 provided on the coulisse 33 and a notch 20, the nose 82 on the coulisse 33 thus preventing the catch 65 from being disengaged from the notch 20 on the slider 8. This eliminates the possibility of moving the shaving apparatus from the position shown in FIG. 4 into an "Off" position by means of the locking switch 62 as long as the cutters are still in their operating positions. When an attempt is made to push down the coulisse 33 by means of the first slide switch 4*a*, the rib structure 89 prevents disengagement of the detent member 55 from its locating position or notch 18. This ensures further that the short-hair cutter assembly K1, K2 cannot be deactivated as long as the long-hair trimmer L is activated. Thus, first the slider 8 must be displaced into the position shown in FIG. 3 using the slide switch 4*a*.

When the first slide switch 4*a* has caused displacement of the slider 8 of the long-hair trimmer L into its "Off" position of FIG. 3, the detent member 55 of the detent hook 54 is released, subsequently enabling the short-hair cutter assembly K1, K2 to be displaced to its "Off" position of FIG. 2 using the slide switch 4*a*.

Only then is it possible to move also the locking switch 62 into its locking or "Off" position of FIG. 2. Accordingly, displacement of the locking switch 62 into its locking position is not possible until the long-hair trimmer L and also the short-hair cutter assembly K1, K2 are deactivated, because the nose 82 has then moved away from the rear side of the catch 65 of the locking switch 62 (see FIG. 3 and subsequently FIG. 2), thus enabling the catch 65 to be disengaged from the notch 20 and fall into the notch 19. When the slide switch 4*a* and the slide switch 4*b* are in the position shown in FIG. 2, also the shaving head 2 of the short-hair cutter assembly K1, K2 is locked by the detent member 77 having been inserted within the opening 75.

We claim:

1. An electric shaving apparatus comprising housing structure, a pivotally mounted short-hair cutter assembly mounted on said housing structure, a long-hair trimmer mounted on said housing structure, a first manually operable slide switch slidably arranged on said housing structure and coupled to both said pivotally mounted short-hair cutter assembly and said long-hair trimmer, said first slide switch for operating said pivotally mounted short-hair cutter assembly and for displacing said long-hair trimmer, and a second manually operable slide switch arranged on said housing structure and coupled to said first slide switch for automatically following movement of said first slide switch into a first control position, said second slide switch being moveable from said first control position relative to said first slide switch to a second position in which said second slide switch contacts said short-hair cutter assembly and locks the pivotal movement of said short-hair cutter assembly.

2. The shaving apparatus of claim 1 and further including control means coupled to said second slide switch and wherein said second slide switch is movable in opposition to the movement of said first slide switch against the action of said control means into said second portion for locking said pivotally mounted short-hair cutter assembly.

3. The shaving apparatus of claim 2 wherein said control means includes a first spring, said second slide switch is movable against the action of said first spring from a non-locking position into a locking position locking said pivotal short-hair cutter assembly, and wherein from said locking position said first spring urges said second slide switch from said locking position into said non-locking position.

4. The shaving apparatus of claim 1 and further including slider structure with a plurality of apertures, each said aperture including an abutment stop and wherein said first and second slide switches each include two relatively spaced guide means which are received in said apertures in said slider structure and are movable into engagement with respective ones of said abutment stops in said respective apertures.

5. The shaving apparatus of claim 4 wherein said slider structure is displaceable in said housing structure and said first and second slide switches are carried on said slider structure and are movable by means of said first slide switch from an "Off" position into at least one operating position.

6. The shaving apparatus of claim 5 and further including coulisse structure in said housing structure, said coulisse structure including a supporting structure, said supporting structure including bearing shell structure and detent structure received in said bearing shell structure, said detect structure including a detent member for arresting said coulisse structure on said slider structure.

7. The shaving apparatus of claim 6 and further including a two-legged spring, the rear side of said detect structure being disposed against said two-legged spring and one leg of said two-legged spring being in locking engagement with said coulisse structure and thereby secured in position.

8. The shaving apparatus of claim 6 wherein said detent member is semispherical, and wherein said detent structure further comprises an arm portion and a rotary foot connected with said semispherical detent member through said arm portion, said rotary foot being coupled to said coulisse structure for rotary movement relative thereto.

9. The shaving apparatus of claim 6 wherein said slider structure includes notch structure, and said detent member of said coulisse structure is engageable with said notch structure of said slider structure, and further including catch structure for controlling the engagement of said detent member with said notch structure, wherein said catch structure is a first position retains the detent member thereby preventing said detent member from disengaging from the notch structure and in a second position release said detent member thereby permitting the detent member to disengage from said notch structure.

10. The shaving apparatus of claim 1 and further including spring structures that has a dead-center position, and wherein said long-hair trimmer includes slider structure that is displaceably mounted in said housing structure thereby enabling said slider structure to move in a first direction and a second direction and wherein said slider structure bears against said housing structure through said spring structure which, after being moved off of said dead-center position, is adapted to displace said slider structure of said long-hair trimmer either in the first direction or the second direction.

11. The shaving apparatus of claim 10 wherein said spring structure has one end thereof fastened to said housing structure and another end in engagement with said slider structure, wherein said slider structure includes a resilient locating element adapted to locate said slider structure in a lower position on said housing structure.

12. The shaving apparatus of claim 10 wherein said first and second slide switches are guided on the upper side of said slider structure, and further including coulisse structure guided on the underside of said slider structure, wherein said coulisse structure is connected to said first slide switch and is adapted to lock said first slide switch in a preselected position.

13. The shaving apparatus of claim 1 and further including coulisse structure in said housing structure, said coulisse structure including two spaced support brackets, and wherein said first slide switch includes coupling elements fixedly connected with said two support brackets of said coulisse structure.

14. The shaving apparatus of claim 1 and further including a locking switch that includes catch structure, said locking switch being displaceable in the same direction as said first and second slide switches when said slide switches are moved to their "Off" positions.

15. The shaving apparatus of claim 14 and further including notched slider structure in said housing structure, and wherein said locking switch includes a plate with first and second resilient catches, in the form of downwardly open fork structure, said first resilient catch being engageable in corresponding notches of said slider structure.

16. The shaving apparatus of claim 15 and further including coulisse structure connected to said first slide and including rib structure in said housing structure, said coulisse structure including a bearing shell structure and a detent structure received in said bearing shell structure, and wherein in a locking position of said locking switch, said first catch slides between the detent structure of said coulisse structure and said rib structure and prevents the detent structure from pivoting about said bearing shell structure and releasing said coulisse structure and thereby preventing said first slide switch from operating said pivotally mounted short-hair cutter assembly.

17. The shaving apparatus of claim 16 wherein in an operating position of the long-hair trimmer, said rib structure obstructing movement of said coulisse structure thereby preventing displacement of said short-hair cutter assembly into an "Off" position.

18. The shaving apparatus of claim 17 wherein said coulisse structure includes a nose portion, and wherein in said operating position of said long-hair trimmer, said second catch is between said nose portion on said coulisse structure and a notch on said slider structure, thereby said nose portion restraining said second catch and preventing said second catch from being disengaged from said notch on slider structure.

19. The shaving apparatus of claim 14 and further including first knob structure at the rear side of said catch structure of said locking switch and second knob structure on said housing structure, said first knob structure, in relation to a locking position of said locking switch, being arranged below said second knob structure.

20. The shaving apparatus of claim 14 wherein said second slide switch includes a control element configured as push rod structure that is slidable carried in said housing structure for locking said short-hair cutter assembly, and biasing structure for biasing said push rod structure in a longitudinal direction of said shaving apparatus.

21. The shaving apparatus of claim 20 and further including slider structure displaceable in said housing structure, said first and second slide switches being carried on said slider structure and being movable by means of said first slide switch from an "Off" position into at least one operating position.

22. The shaving apparatus of claim 21 and further including coulisse structure in said housing structure, said coulisse structure including two spaced support brackets, and wherein said first slide switch includes coupling elements fixedly connected with said two support brackets of said coulisse structure.

23. The shaving apparatus of claim 1 and further including slider structure and a semispherical raised portion in said housing structure, said slider structure including a resilient locating element which in an "Off" position of said shaving apparatus is slid over said semispherical raised portion, and as said slider structure is displaced into an operating position, said locating element travels over said semispherical raised portion.

24. The shaving apparatus of claim 23 and further including coulisse structure in said housing structure and wherein said long-hair trimmer is connected to said slider structure and wherein in a retracted position of said long-hair trimmer, said coulisse structure is in abutting engagement with the rear end of said locating element thereby preventing said slider structure from moving said long-hair trimmer out of its locked position.

25. The shaving apparatus of claim 1 wherein said second slide switch includes a control element configured as push rod structure that is slidable carried in said housing structure for locking said short-hair cutter assembly, and biasing structure for biasing said push rod structure in a longitudinal direction of said shaving apparatus.

26. The shaving apparatus of claim 25 wherein said push rod structure associated with said second slide switch through engaging structure provided on said push rod and is movable by means of said second slide switch against the action of at least one spring into a position locking said short-hair cutter assembly.

* * * * *